US008301049B2

(12) United States Patent
Omelchenko et al.

(10) Patent No.: US 8,301,049 B2
(45) Date of Patent: Oct. 30, 2012

(54) CHARACTERIZATION OF TONER PATCH SENSOR IN AN IMAGE FORMING DEVICE

(75) Inventors: Mark A. Omelchenko, Lexington, KY (US); John Parker Richey, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 607 days.

(21) Appl. No.: 11/942,267

(22) Filed: Nov. 19, 2007

(65) Prior Publication Data

US 2009/0129800 A1 May 21, 2009

(51) Int. Cl.
*G03G 15/00* (2006.01)

(52) U.S. Cl. ..... 399/49

(58) Field of Classification Search ..... 399/49, 399/55, 60, 72

See application file for complete search history.

(56) References Cited

U.S. PATENT DOCUMENTS

| | | | | |
|---|---|---|---|---|
| 5,754,922 | A * | 5/1998 | Bessho | 399/52 |
| 2003/0049039 | A1* | 3/2003 | Suzuki | 399/49 |
| 2004/0042807 | A1* | 3/2004 | Nakayama | 399/49 |
| 2004/0208661 | A1* | 10/2004 | Kitagawa et al. | 399/49 |
| 2005/0232648 | A1* | 10/2005 | Nishizawa et al. | 399/49 |
| 2006/0024077 | A1* | 2/2006 | Scheuer et al. | 399/74 |
| 2009/0129799 | A1 | 5/2009 | Omelchenko | |

FOREIGN PATENT DOCUMENTS

| | | | |
|---|---|---|---|
| JP | 04256982 | A | 9/1992 |
| JP | 06027779 | A * | 2/1994 |
| JP | 2000029256 | A | 1/2000 |
| JP | 2006139180 | A | 6/2006 |

OTHER PUBLICATIONS

Computer Translation of JP2000029256A.

* cited by examiner

*Primary Examiner* — Walter L Lindsay, Jr.
*Assistant Examiner* — Barnabas Fekete

(57) ABSTRACT

A characterization procedure for the a detector in a toner patch sensor of an electrophotographic image forming device is performed with the toner patch sensor operatively connected to the image forming device's power supply. During the characterization procedure, a gain setting is determined that produces a predetermined target output from the toner patch sensor based on electromagnetic radiation reflected from a reference reflectivity sample. Subsequently, a toner patch is generated by the image forming device and a reflectance of the toner patch is measured based on the gain setting, with the toner patch sensor operatively connected to the power supply. The measurement(s) may then be used to adjust at least one electrophotographic image forming parameter. More than one reference reflectivity sample may be used, with corresponding gain settings stored in the image forming device.

22 Claims, 6 Drawing Sheets

CHARACTERIZATION OF TONER PATCH SENSOR IN AN IMAGE FORMING DEVICE

BACKGROUND

The electrophotographic (EP) process used in some imaging devices, such as laser printers and copiers, is susceptible to variations due to environmental changes and component life. This variability may have a greater impact on color EP printers because it may cause changes in the toner density of developed images, which in turn causes objectionable color shifts. It is general practice in the industry to incorporate sensors that measure the toner density of test images and provide feedback to the control system for making adjustments to various EP printing process parameters, such as bias voltages and/or laser power. Ideally, these adjustments increase or decrease the amount of toner developed out to the latent image to achieve a desired density.

One common approach to making the adjustments is to measure the reflectivity of a "toner patch" formed inside the printer in order measure the amount of toner being used during the development process. A so-called "toner patch sensor" is used for this purpose, and typically includes an infrared emitter and an associated detector. As can be appreciated, it is advantageous to characterize the toner patch sensor in order to achieve more reliable measurement results so that appropriate adjustments to various EP printing parameters may be made. However, existing methods of characterizing toner patch sensors have proven less than ideal in some circumstances. As such, there remains a need for alternative approaches to characterizing toner patch sensors, and using the corresponding characterization information.

SUMMARY

The present application is generally directed to methods and devices for operating a toner patch sensor in an electrophotographic image forming device. Operating the toner patch sensor may include a characterization procedure for the toner patch sensor's light detector that is performed with the toner patch sensor operatively connected to the image forming device's power supply. During the characterization procedure, a gain setting is determined that produces a predetermined target output from the toner patch sensor based on electromagnetic radiation reflected from a reference reflectivity standard. Subsequently, a toner patch is generated by the image forming device and a reflectance of the toner patch is measured with the toner patch sensor operatively connected to the power supply and based on the gain setting. The measurement(s) may then be used to adjust at least one electrophotographic image forming parameter. In some embodiments, more than one reference reflectivity standard is used and corresponding gain settings are stored in the image forming device.

DETAILED DESCRIPTION

The present application is generally directed to methods and devices for operating a toner patch sensor in an electrophotographic image forming device, such as a printer or copier. The toner patch sensor includes a detector, typically a light detector. The toner patch sensor is characterized using a characterization procedure. In one embodiment, two or more reference standards are used, and a gain setting is determined that produces a predetermined target output from the toner patch sensor for each of the standards. Advantageously, the characterization procedure is carried out with the toner patch sensor operatively connected to the device's power supply. The gain settings from the characterization procedure are stored in memory for later use in the operation of the image forming device.

An exemplary electrophotographic image forming device 100 is described below in order to provide an understanding of the principles and context of the methods and devices disclosed herein. The exemplary image forming device 100 described is a color laser printer, and may be referred to herein as the "printer" 100. However, it should be understood that the electrophotographic image forming device 100 may, in various details, take forms other than that described below. For example, the image forming device 100 may be a monochrome printer, a color copier, a monochrome copier, or any other image forming device using the electrophotographic image forming process.

Figure 1:
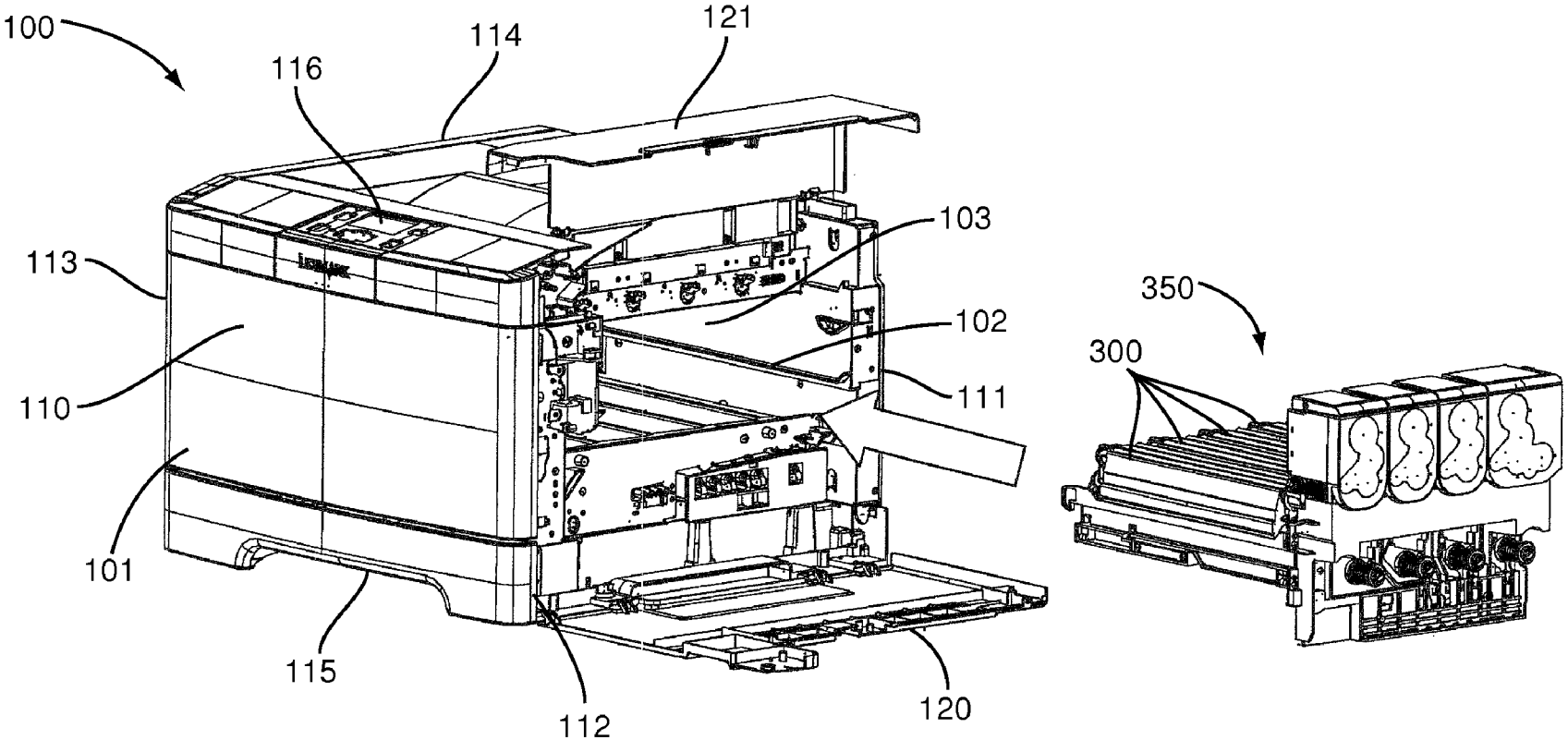
FIG. 1 is a perspective view of an image forming device according to one embodiment.

As illustrated in FIG. 1, one exemplary image forming device 100 suitable for the present invention includes a housing 101 with a front side 110, back side 111, lateral sides 112, 113, a top side 114, and a bottom 115. A door 120 may be pivotably positioned across an opening that leads into an interior 103 of the housing 101. Another door 121 may be positioned on the top side 114 of the housing 101. Guide rails 102 are advantageously positioned within the interior 103 to receive and position the imaging unit 350. A control panel 116 may be positioned on the exterior and include various input mechanisms for operating the image forming device 100. Using the control panel 116, the user is able to enter commands and generally control the operation of the image forming device 100. For example, the user may enter commands to switch modes (e.g., color mode, monochrome mode), view the number of images printed, take the device on/off line to perform periodic maintenance, and the like.

Figure 2:
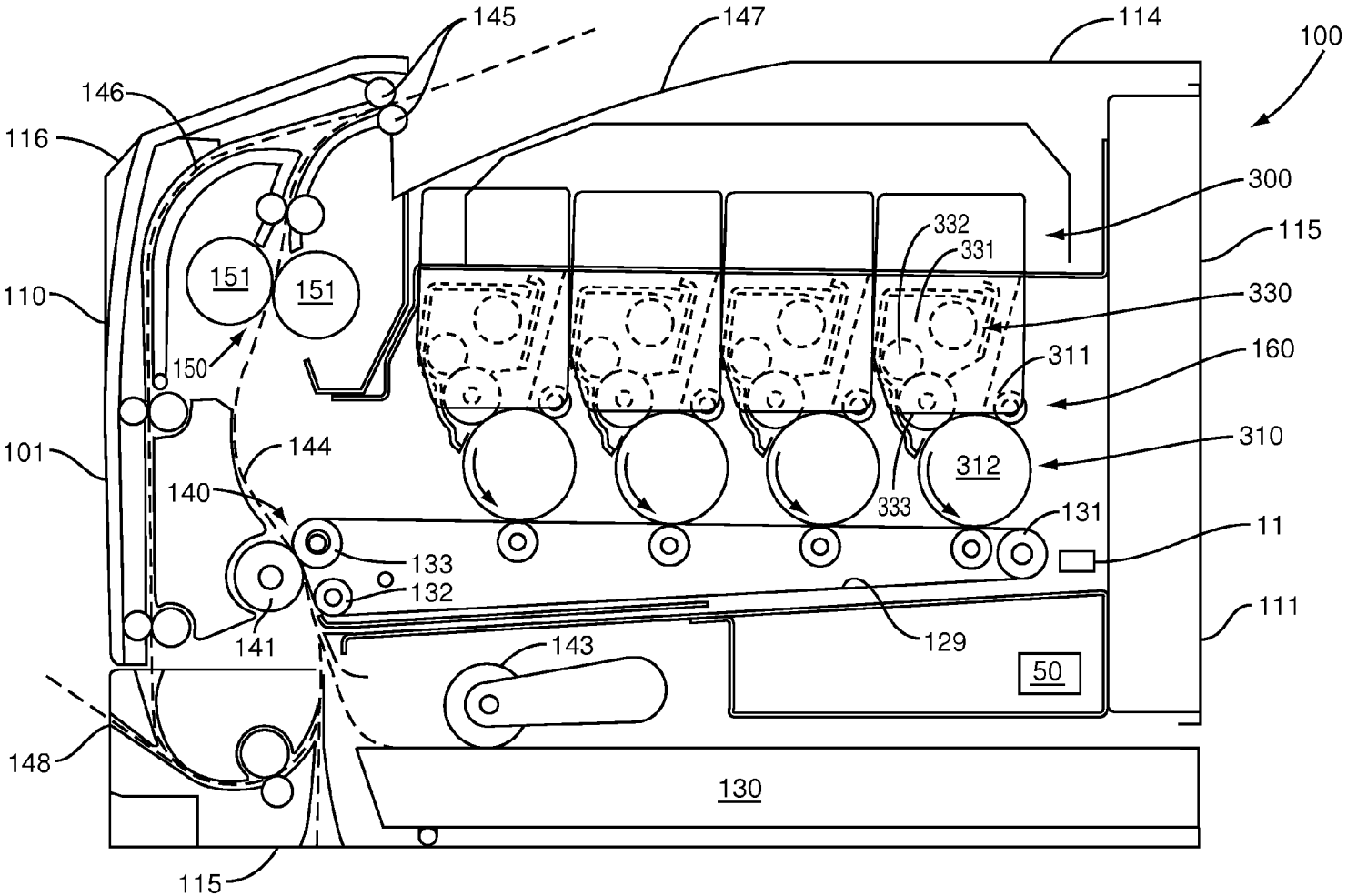
FIG. 2 is a schematic drawing of an image forming device according to one embodiment.
Figure 3:
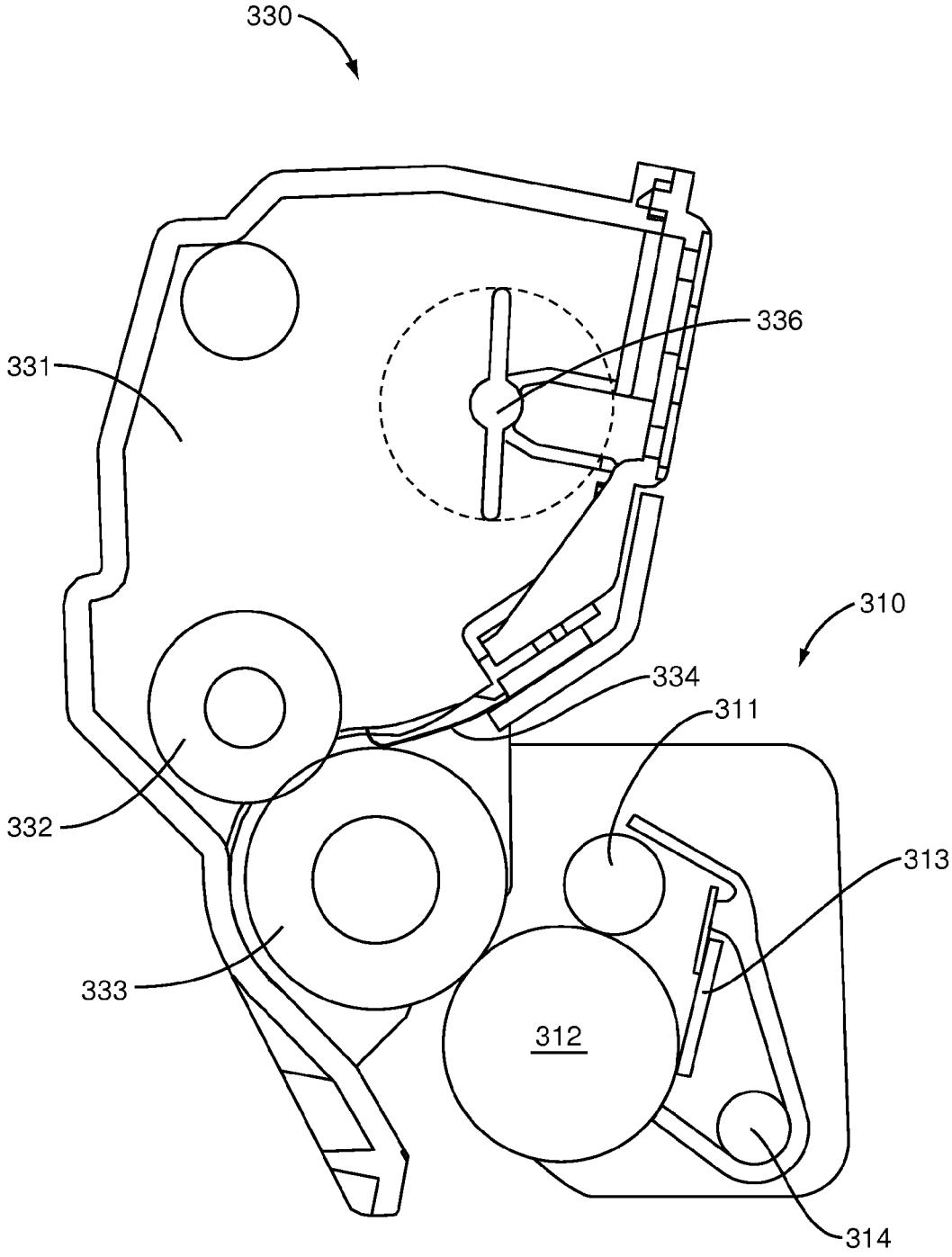
FIG. 3 is a schematic drawing of a photoconductor unit and a developer unit according to one embodiment.

Various internal components of the image forming device 100 are illustrated in FIGS. 2-3. A first toner transfer area 160 includes one or more imaging stations 300 that each include a photoconductor unit 310 and a developer unit 330. The developer unit 330 includes a toner reservoir 331 to contain the toner. One or more agitating members 336 may further be positioned within the reservoir 331 to move the toner. Developer unit 330 further includes a toner adder roller 332 that moves the toner supplied from the reservoir 331 to a developer roller 333. A doctor blade 334 may abut against the surface of the developer roller 333 to control the amount of toner that adheres to the roller 333.

The photoconductor unit 310 includes the photoconductive (PC) drum 312, charging roller 311, and a cleaner blade 313. The charging roller 311 forms a nip with the PC drum 312, and charges the surface of the PC drum 312 to a specified voltage, such as −1000 volts. A laser beam from a printhead (not shown) is directed to the surface of the PC drum 312 and discharges those areas it contacts to form a latent image. In one embodiment, areas on the PC drum 312 illuminated by the laser beam are discharged to approximately −300 volts. The developer roller 333, which also forms a nip with the PC drum 312, then transfers toner to the PC drum 312 to form a toner image. The toner is attracted to the areas of the PC drum 312 surface discharged by the laser beam from the printhead. Cleaning blade 313 acts to remove excess toner from PC drum 312. In some embodiments, an auger 314 may move the waste toner removed by the cleaner blade 313 to a waste toner reservoir.

Each of the imaging stations 300 is advantageously mounted such that photoconductive (PC) drums 312 of the respective photoconductor units 310 are substantially parallel and horizontally aligned within housing 101. In one embodiment, each of the imaging stations 300 is substantially the same except for the color of toner. Thus, for purposes of clarity, the photoconductor unit 310 and the developer unit 330 are labeled on only one of the imaging stations 300.

An intermediate transfer mechanism (ITM) 129 is disposed adjacent to each of the imaging stations 300. In this embodiment, the ITM 129 is formed as an endless belt trained about drive roller 131, tension roller 132 and back-up roller 133. During image forming operations, the ITM 129 moves past the imaging stations 300 in a clockwise direction as viewed in FIG. 2. One or more of the PC drums 312 apply toner images in their respective colors to the ITM 129. In one embodiment, a positive voltage field attracts the toner image from the PC drums 312 to the surface of the moving ITM 129.

The ITM 129 rotates and collects the one or more toner images from the imaging stations 300 and then conveys the toner images to a media sheet at a second transfer area. The second transfer area includes a second transfer nip 140 formed between the back-up roller 133 and a second transfer roller 141.

A media path 144 extends through the device 100 for moving the media sheets through the imaging process. Media sheets are initially stored in the input tray 130 or introduced into the housing 101 through a manual feed 148. As shown in FIG. 2, the media input tray 130 may be positioned in a lower section of a housing 101 and sized to contain a stack of media sheets that will receive color and/or monochrome images. The media input tray 130 is preferably removable for refilling. The sheets in the input tray 130 are picked by a pick mechanism 143 and moved into the media path 144. In this embodiment, the pick mechanism 143 includes a roller positioned at the end of a pivoting arm that rotates to move the media sheets from input tray 130 towards the second transfer area. In one embodiment, the pick mechanism 143 is positioned in proximity (i.e., less than a length of a media sheet) to the second transfer area with the pick mechanism 143 moving the media sheets directly from the input tray 130 into the second transfer nip 140. For sheets entering through the manual feed 148, one or more rolls are positioned to move the sheet into the second transfer nip 140.

The media sheet receives the toner image from the ITM 129 as it moves through the second transfer nip 140. The media sheets with toner images are then moved along the media path 144 and into a fuser area 150. Fuser area 150 includes fusing rolls or belts 151 that form a nip to adhere the toner image to the media sheet. The fused media sheets then pass through exit rolls 145 that are located downstream from the fuser area 150. Exit rolls 145 may be rotated in either forward or reverse directions. In a forward direction, the exit rolls 145 move the media sheet from the media path 144 to an output area 147. In a reverse direction, the exit rolls 145 move the media sheet into a duplex path 146 for image formation on a second side of the media sheet.

The image forming device 100 may include one or more power supplies, indicated generally by reference number 50 in FIG. 2. The power supply 50 may provide the voltage necessary to electronically bias the PC drums 312, bias charging rollers 311, and bias developer rollers 333. In addition, power supply advantageously powers toner patch sensor 11 during the characterization procedure and subsequent toner patch sensing operations, as discussed further below. The power supply 50 may, in some embodiments, be distributed to various locations within device 100, and may include suitable sections for AC and DC power, as is appropriate.

Numerous EP image forming parameters are controlled by a suitable control circuit 20 (see FIG. 4) in the device 100. The control circuit 20 may take any form known in the art, such as a suitably programmed processor, discrete circuitry, or a combination thereof. Relevant to the present discussion, the control circuit 20 helps control the voltage of the PC drum 312, the bias applied to developer roller 333, the laser power from the printhead, the white vector, the timing of various printing activities, and the like. From time to time, the control circuit 20 causes a toner patch sensing operation to be performed. In the toner patch sensing operation, a toner patch is deposited on the ITM 129 and the optical properties of the toner patch are then sensed to determine the amount of toner being deposited. A toner patch sensing circuit 10 (see FIG. 4) is used to take the desired measurements on the toner patch, typically by shining infrared light on the toner patch, and then sensing the light reflected from the toner patch. Based on the measurements from the toner patch sensing operation, the control circuit 20 makes suitable adjustments to the EP image forming parameters.

Figure 4:
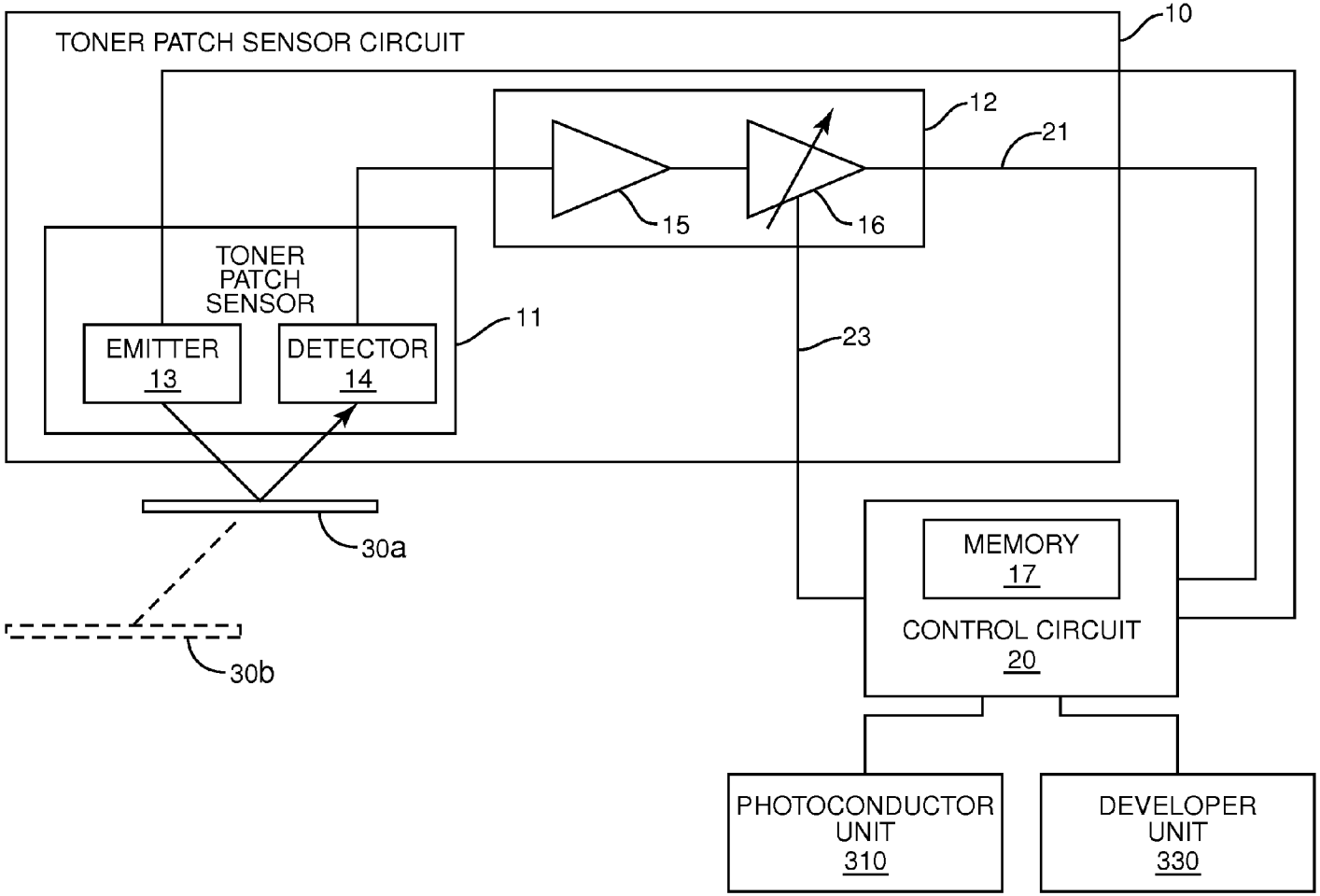
FIG. 4 is a schematic circuit diagram of a toner patch sensor circuit according to one embodiment.

One embodiment of toner patch sensor circuit 10 is shown in FIG. 4. For the sake of brevity, the present discussion will be in the context of a device having one toner patch sensor circuit 10; however, it should be understood that the device 100 may, in some embodiments, contain multiple toner patch sensor circuits 10 which may be used singly or jointly in a toner sensing operation. One or multiple ones of such toner patch sensor circuits 10 may be characterized according to the methods described herein. The toner patch sensor circuit 10 includes a toner patch sensor 11 and a suitable amplification circuit 12. The toner patch sensor 11 includes an emitter 13 and a corresponding detector 14. The emitter 13 typically takes the form of an LED that emits suitable infrared light. It is understood by one skilled in the art that the emitter 13 may be constructed of other types of light sources, including but not limited to laser, incandescent, chemoluminescent, and gas-discharge, and may emit ultraviolet, visible, or near visible light. The detector 14 typically takes the form of a cascade photodetector that is suitable for detecting the infrared light emitted by the emitter 13. It is also understood by one skilled in the art that the detector 14 may take the form of a photosensitive diode, photocell, phototransistor, CCD, or CMOS. The emitter 13 and detector 14 may be jointly housed or be distinct elements. The toner patch sensor 11 is oriented so as to be aimed at the ITM 129 downstream of the imaging stations 300, advantageously at a location where the ITM 129 is in a relatively constant relative position, such as at drive roller 131 (see FIG. 2).

The detector 14 outputs a relatively low voltage signal that is amplified by amplification circuit 12. In a simple embodiment, the amplification circuit 12 includes a first amplifier 15 and a second amplifier 16. The first amplifier 15 is advantageously a fixed gain amplifier, which may advantageously have a non-linear gain such that higher frequency components of the signal from the detector 14 have less gain than lower frequency components. The second amplifier 16 advantageously is a variable gain amplifier, whose output forms the output of toner patch sensor circuit 10. The gain of second amplifier 16 is controlled by a gain control signal on line 23 from control circuit 20. In one embodiment, the gain control signal takes the form of a pulse width modulated (PWM) signal. The duty cycle of the PWM gain control signal may be adjusted to modify an the gain of second amplifier 16, and thus the voltage of the output signal 21 of the second amplifier 16. Thus, the voltage of output signal 21 from toner patch sensor circuit 10 may be varied to obtain a desired voltage in response to a given amount of light sensed by the detector 14 by adjusting the duty cycle of the PWM gain control signal on line 23. As discussed further below, this feature may be used to calibrate the toner patch sensor circuit 10 to provide a predetermined voltage of the output signal 21 for one or more reflectance standards. The characteristics of the gain control signal, such as the PWM duty cycle, during the toner patch sensing operation are advantageously based on values stored in memory 17, as also discussed further below. The control circuit 20 uses the information from the toner patch sensing circuit 10 to adjust various EP image forming parameters in any fashion known in the art.

It should be understood that the toner patch sensing circuit 10 may take other forms than shown in FIG. 4, provided that the reflected electromagnetic radiation (e.g., infrared light) from the toner patch can be detected and a variable amount of gain can be applied to the detection signal. For example, the toner patch sensing circuit 10 may include suitable analog to digital converters so that the input to the control circuit may be digital, if desired.

Prior to using the toner patch sensor circuit 10 in a toner patch sensing operation, the toner patch sensor circuit 10 may be subjected to a characterization procedure to achieve a desired response of output signal 21. In one embodiment, multiple reflectance standards may be used to calibrate the response of the toner patch sensor circuit 10. The characterization procedure may also include steps to verify proper operation of the emitter 13 and the gain control signal from control circuit 20. In one embodiment, the characterization procedure is performed outside of the image forming device 100. In another embodiment, the characterization procedure is performed after installing the toner patch sensor circuit 10 within the image forming device 100. In this latter embodiment, the toner patch sensor circuit, or at least the toner patch sensor 11, may be powered by the same power supply 50 during the characterization procedure and during subsequent operation of the image forming device 100.

Figure 5:
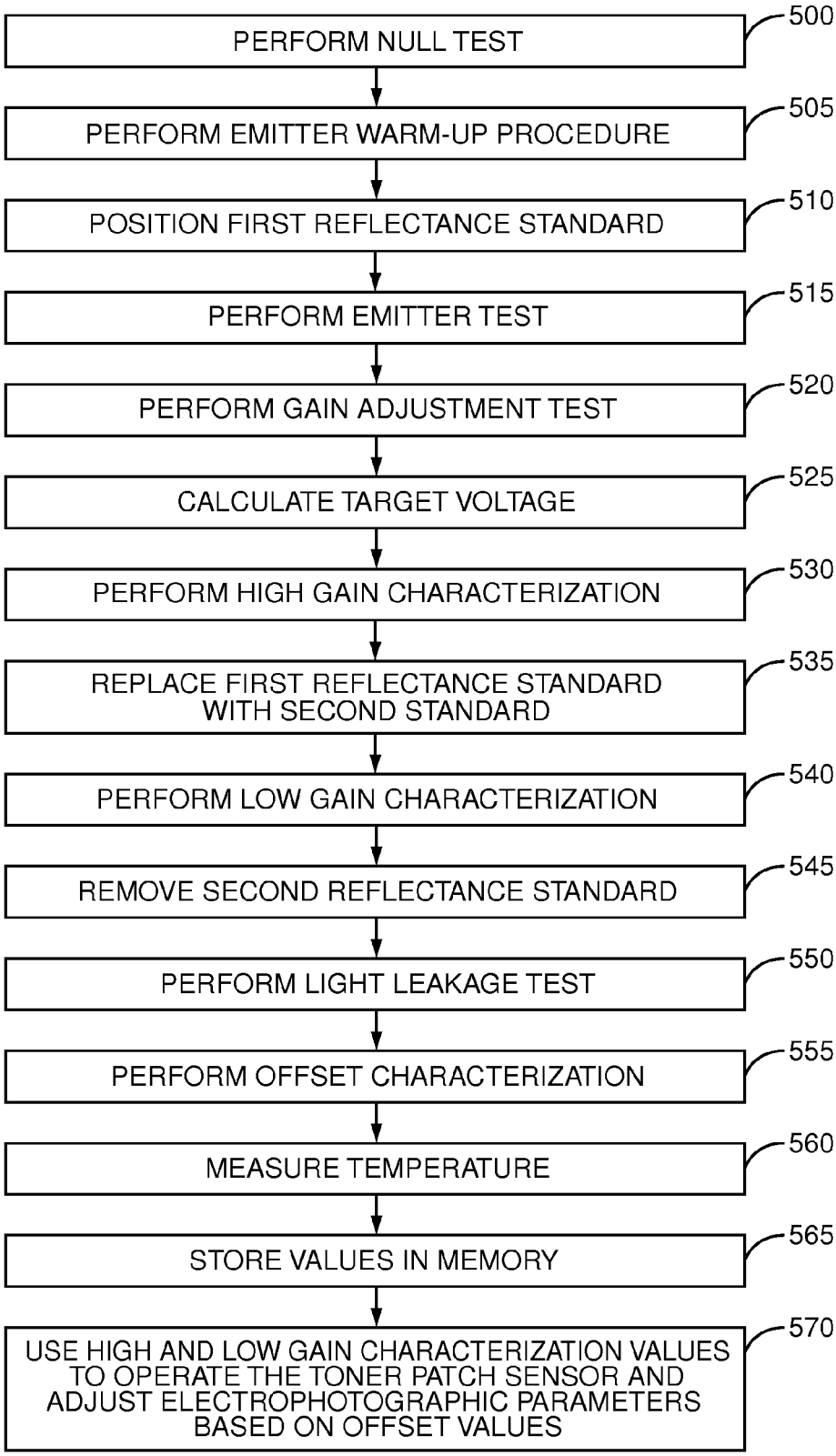
FIG. 5 is a flow diagram of a toner patch sensor characterization procedure according to one embodiment.

FIG. 5 illustrates a flow diagram for a characterization procedure utilizing two reflectance standards. Prior to illuminating the emitter 13, a null test is performed (block 500) to determine the response of the detector 14 in the absence of light from the emitter 13 and the duty cycle of the PWM gain control signal of the second amplifier 16 set to zero percent. During the null test, the voltage of output signal 21 from the toner patch sensor circuit 10 should be below a predetermined value. In one embodiment, the predetermined value is about 0.020 V. Following the null test, a warm-up procedure for the emitter 13 (block 505) may be performed. The warm-up procedure includes applying a high current to the emitter 13 for a specified period of time, followed by turning off the current for a second period of time. A normal operating current is then applied to the emitter 13 for a third period of time. The warm-up procedure is helpful because the intensity of the light emitted by the emitter 13 may vary with the temperature of the emitter 13. The warm-up procedure ramps up the temperature of the emitter 13 to a point where the intensity is more consistent and there is less variability due to the temperature of the emitter 13 introduced during the characterization procedure.

A first reflectance standard 30*a* is then placed in view of the detector 14 (block 510) such that light from the emitter 13 is reflected by the reference standard 30*a* toward the detector 14. In one embodiment, the first reflective standard 30*a* has a known reflectance of between about four percent to about eight percent, such as about five percent. This first reflectance standard 30*a*, in one embodiment, may be thought of as the "high gain" standard due to its relatively low reflectivity. An emitter test is then performed (block 515) by first applying the normal operating current to the emitter 13 and setting the duty cycle of the PWM gain control signal of the second amplifier 16 to fifty percent. The voltage of output signal 21 should be greater than a predetermined amount. In one embodiment, this predetermined amount is about 1.0 V. If the toner patch sensor circuit 10 passes both the null test and the emitter test, then the characterization procedure is allowed to continue.

With the first reference standard 30*a* still positioned in view of the detector 14, the duty cycle of the PWM gain control signal of the second amplifier 16 may be tested in what may be referred to as a gain adjustment test (block 520). While applying the normal operating current to the emitter 13, the duty cycle of the PWM gain control signal is varied from zero to one hundred percent duty cycle. The purpose of the gain adjustment test is to assure that a desired upper and lower voltages of output signal 21 can be obtained within the duty cycle range. Both of the desired output voltages 21 must be obtained during the gain adjustment test to pass. In one embodiment, the lower output voltage 21 is 1.0 V±0.020 V, and the upper output voltage 21 is 3.0 V±0.020 V.

In one embodiment, the first reflectance standard 30*a* has a desired reflectance of 5.0%, and a second reflectance standard 30*b* has a desired reflectance of 40.0%. In one embodiment, the desired voltage values of output signal 21 for these standards 30*a*, 30*b* are 2.2 V and 1.6 V, respectively. These desired voltages assume that the standards 30*a*, 30*b* are exactly 5.0% and 40.0% reflectance. However, the standards 30*a*, 30*b* may, in actuality, vary slightly from ideal. Therefore, a target output voltage may be calculated (block 525) for each standard 30*a*, 30*b* to compensate for the actual reflectance of the standard 30*a*, 30*b*. The target output voltage may be calculated using the following equation:

$$\text{Target Voltage}=(\text{Actual Reflectance}/\text{Desired Reflectance})\times\text{Desired Voltage}$$

For example, if the actual reflectance of the first reflectance standard is 5.1 percent, the target output voltage is then calculated as:

$$\text{Target Voltage}=(5.1\%/5.0\%)\times 2.2\text{ V}=2.244\text{ V}$$

With the first reflectance standard 30*a* again still positioned in view of the detector 14, a high gain characterization procedure (block 530) is performed. The duty cycle of the PWM gain control signal for the second amplifier 16 is adjusted until the target output voltage as calculated above for the first reflectance standard 30*a* is achieved at the output 21 of the toner patch sensor circuit 10 (or, in the alternative, as close to the target value as can be achieved by adjusting the gain). In one embodiment, the duty cycle value that results in the target value being achieved is stored in memory 17 as the characterization value, as discussed further below. For purposes of identification, this may be referred to as the high gain characterization value.

Next, the first reflectance standard 30*a* is replaced with the second reflectance standard 30*b* (block 535), and a low gain characterization procedure (block 540) is performed. In one embodiment, the second reflective standard 30*b* has a known reflectance of between about twenty percent to about fifty percent, such as about forty percent. This second reflectance standard 30*b*, in one embodiment, may be thought of as the "low gain" standard due to its relatively higher reflectivity. The duty cycle of the PWM gain control signal for the second amplifier 16 is adjusted until the target output voltage as calculated above is achieved at the output 21 of the toner patch sensor circuit 10 (or, in the alternative, as close to the target value as can be achieved by adjusting the gain). Again, the duty cycle value that results in the target value being achieved is stored in memory 17 as the characterization value, as discussed further below. For purposes of identification, this may be referred to as the low gain characterization value. Following completion of the low gain characterization procedure, the second reflectance standard 30*b* is removed from view of the detector 14 (block 545).

A light leakage test may then be performed (block 550) to determine the response of the detector 14 when the emitter 13 is illuminated at the normal operating current and there is no surface to reflect the light from the emitter 13 (i.e., neither the first nor the second reflectance standards 30*a*, 30*b* is positioned in view of the detector 14). The light leakage test may also include further isolating the emitter 13 and detector 14 from outside light sources by, for example, placing a black box around them. The duty cycle of the PWM gain control signal for the second amplifier 16 is set to the value determined during the high gain characterization procedure. The resulting voltage of output signal 21 should not exceed a predetermined value. In one embodiment, this predetermined value is about 0.25 V.

Following the light leakage test, an offset characterization test is performed (block 555). A first part of this test is conducted similar to the light leakage test described above with the duty cycle of the PWM gain control signal for the second amplifier 16 set to the value determined during the high gain characterization procedure, except that no black box is used to shield the detector 14. The resulting voltage of output signal 21 is determined and is subtracted from the voltage achieved during the high gain characterization procedure to give a first offset voltage value. A second part of this test is conducted with the duty cycle of the PWM gain control signal for the second amplifier 16 set to the value determined during the low gain characterization procedure. The resulting voltage of output signal 21 is determined and is subtracted from the voltage achieved during the low gain characterization procedure to give a second offset voltage value. The first and second offset voltage values may also be stored in memory 17.

The characterization procedure may also include a temperature calibration step (block 560). The intensity of the light emitted by the emitter 13 may vary with temperature. Variability may be introduced into the toner patch sensing operation if the temperature of the emitter 13 is different during the toner patch sensing operation than the temperature during the characterization procedure. Therefore, the temperature during the characterization test is measured (block 560), and this value may be used by the control circuit 20 to compensate for a temperature difference during later toner patch sensing operations. In one embodiment, the temperature of the detector 14 is measured, and this value is assumed to approximate the temperature of the emitter 13.

The voltage, gain, and temperature values determined during the characterization procedure may be stored in memory 17 (box 565). The voltage values may include the voltages achieved during the low and high gain characterization procedures and the voltages determined during the light leakage test, as well as the offset voltage values. The stored voltage values may also include the target output voltages. The stored characterization values may include the duty cycle values determined during the low and high characterization procedures, as well as the duty cycle values determined during the gain adjustment test. The temperature values stored may include the temperature of the detector 14 and the emitter 13 (if measured). The voltage, gain, and temperature values stored in memory 17 are now available for operating the toner patch sensor 11 and for adjusting electrophotographic parameters of the imaging unit 350 (block 570).

Some embodiments discussed above use two reflectance standards 30*a*,30*b*, those standards being five and forty percent. However, more than two reference standards 30*a*,30*b* may be used, and standards other than five and forty percent may be used. For example, reference standard 30*a* may have a reflectivity of about ten percent, and reference standard 30*b* may have a reflectivity of about twenty-five percent. Advantageously, for a color image forming device 100, the reference standards are selected to approximate the expected reflectivity of black and color toner, either on the ITM 129 or on a media sheet, as is appropriate. Additionally, toner patch sensors 11 may be used that include more than one emitter 13 and more than one detector 14. For example, the teachings provided herein may be applied to toner patch sensors 11 where a diffuse emitter 13 is used with a diffuse detector 14 and a specular emitter 13 is used with a specular detector 14 and the outputs from the multiple detectors 14 combined.

Additionally, the present application may be used with image forming devices 100 that do not include an ITM 129, such as direct transfer devices that transfer toner directly from the PC drums 312 to the media sheet. For the direct transfer device, the toner patch would be transferred to the media sheet rather than the ITM 129, and the media sheet would be transported within the device 100 until the toner patch was positioned in view of the toner patch sensor 11. The present application may also be used with an image forming devices 100 that use a belt to transport the media sheet to the imaging stations 300. Further still, the discussion above has generally been in terms of a color image forming device 100 as illustrated in FIGS. 1-2. However, it may also be advantageous to use the characterization procedure described herein for a monochrome image forming device 100.

A number of the steps of the characterization procedure illustrated in FIG. 5 may be considered optional. In addition, some of the steps may be performed in a variety of orders other than the order illustrated in FIG. 5. However, it is believed that the more accurate results may be obtained by using all of the identified steps performed in the order indicated.

As mentioned above, the toner patch sensor characterization procedure of FIG. 5 may be carried out on a test bench. For such an arrangement, the relevant values may be stored in suitable memory that is subsequently installed in the image forming device 100 and/or may be downloaded into the image forming device 100 for storage in memory 17.

Figure 6:
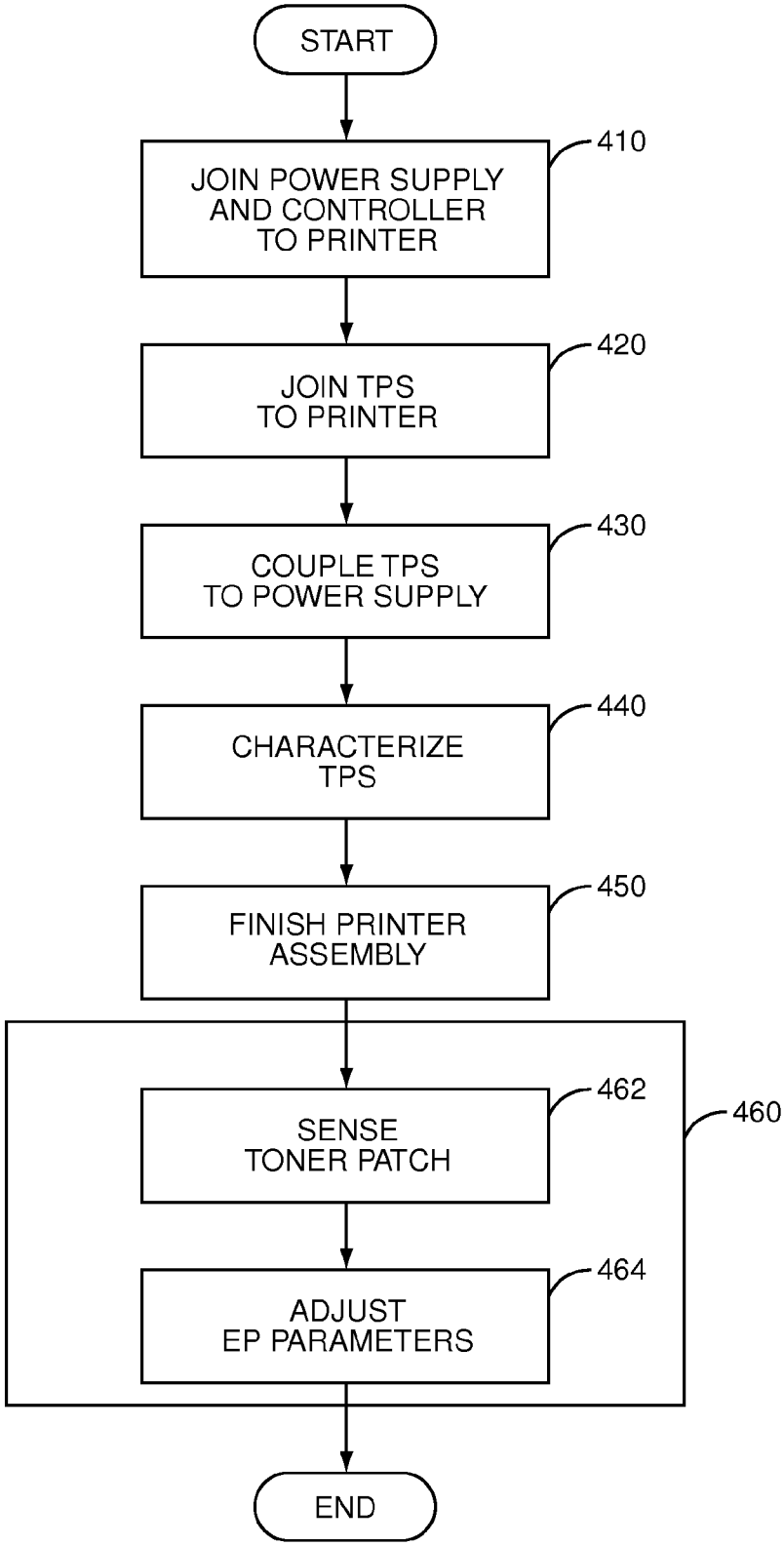
FIG. 6 is a flow diagram of a toner patch sensor characterization procedure according to another embodiment.

In addition, as mentioned above, toner patch sensor characterization may be carried out with the toner patch sensor 10 installed in the image forming device 100. One exemplary process for doing so is shown in FIG. 6. The process begins with the a power supply 50 and control electronics being joined to a printer housing 101 (box 410). The control electronics includes the control circuit 20 and memory 17. The toner patch sensor 10 is then mounted in the printer housing 101 at the desired operational location (box 420). The toner patch sensor 10 is operatively coupled to the power supply 50

(box 430). With the toner patch sensor 10 powered by the power supply 50, the characterization process of FIG. 5 is then performed (box 440). The relevant characterization values are stored in memory 17. The characterization process may be performed with the imaging stations 300 installed in the housing 101 or before the imaging stations 300 are installed. The assembly of the printer 100 is then completed in a conventional fashion (box 450). Thereafter, a toner patch sensing operation is performed (box 460) with the toner patch sensor 10 operatively connected to the power supply 50. During this toner patch sensing operation, the settings for the toner patch sensor 10 are based on the relevant characterization values stored in memory 17. For example, if a black toner patch is being tested, the gain of the toner patch sensor 10 is based on the high gain setting established during the characterization process, optionally as modified based on temperature. Likewise, if a color toner patch is being tested, the gain of the toner patch sensor 10 is based on the low gain setting established during the characterization process, again optionally modified based on temperature. The reflectivity sensed by the toner patch sensor 10 (box 462) is used by control circuit 20 to adjust one or more EP print parameters (box 464) in a conventional fashion. Thus, the process of FIG. 6 results in the toner patch sensor 10 being characterized using the same power supply 50 as the toner patch sensor 10 uses during the toner patch sensing operation used to adjust the EP print parameters. This arrangement is believed to result in less error in the toner patch sensing operation.

It should be noted that at least some of the steps of FIG. 6 may be carried out in other sequences. For example, the toner patch sensor 10 may be added to the printer housing 101 (box 420) prior to the power supply 50 being associated with the housing 101 (box 410), etc. Likewise, memory 17 may be joined to housing 101 early in the process or at any time before the relevant toner patch sensing operation. Also, while the process of FIG. 6 assumes that at least two reference standards 30*a*,30*b* will be used during the characterization process, some embodiments may use an alternative characterization process similar to that shown in FIG. 5, but using only one reference standard 30*a* (and storing the associated characterization value), rather than two or more.

The various aspects described above may be used alone or in combination, as is desired. For example, the characterization process using two or more reference standards 30*a*,30*b* may be carried out with the toner patch sensor 10 outside the printer housing 101, or may be carried with the toner patch sensor 10 installed in the corresponding printer housing 101. Likewise, characterization process that occurs with the toner patch sensor 10 joined to the corresponding power supply 50 (e.g., both mounted to the same "permanent" housing 101) may use multiple reference standards 30*a*, 30*b*, or only one reference standard 30*a*.

Spatially relative terms such as "under," "below," "lower," "over," "upper," and the like, are used for ease of description to explain the positioning of one element relative to a second element. These terms are intended to encompass different orientations of the device in addition to different orientations than those depicted in the figures. Further, terms such as "first," "second," and the like, are also used to describe various elements, regions, sections, etc. and are also not intended to be limiting. Like terms refer to like elements throughout the description.

As used herein, the terms "having," "containing," "including," "comprising," and the like are open ended terms that indicate the presence of stated elements or features, but do not preclude additional elements or features. The articles "a," "an" and "the" are intended to include the plural as well as the singular, unless the context clearly indicates otherwise.

The present invention may be carried out in other specific ways than those herein set forth without departing from the scope and essential characteristics of the invention. Further, the various aspects of the disclosed device and method may be used alone or in any combination, as is desired. The disclosed embodiments are, therefore, to be considered in all respects as illustrative and not restrictive, and all changes coming within the meaning and equivalency range of the appended claims are intended to be embraced therein.

What is claimed is:

1. A method of operating an electrophotographic image forming device, comprising:

providing a housing;

associating a power supply with said housing;

associating a control circuit including memory with said housing;

associating an emitter and an associated detector with said housing;

operatively coupling said emitter and said detector to said power supply and said control circuit;

thereafter, while said emitter and detector are operatively connected to said power supply, emitting light from said emitter onto a first reference sample having a predetermined first reflectivity, measuring the light reflected therefrom with said detector, and producing a first signal corresponding to said light reflected from said first reference sample;

adjusting a duty cycle of a pulse width modulation control signal so as to cause said first signal to substantially match a first predetermined target;

storing said adjusted duty cycle in said memory as a first characterization value, said first characterization value comprising a first duty cycle value corresponding to said adjusted duty cycle used to amplify said first signal to substantially match said first predetermined target;

thereafter, generating a first toner patch inside said housing and measuring a reflectance of said first toner patch with said emitter and detector based on said first characterization value while said emitter and detector are operatively connected to said power supply, and adjusting at least one electrophotographic image forming parameter based thereon; and prior to said generating a first toner patch, removing said first reference sample, emitting light from said emitter with no reference sample for said light to reflect on, measuring a signal output of said detector while driving said detector according to said first characterization value, and determining an offset value corresponding to a difference between said signal output and the first signal as amplified by said adjusted duty cycle; and wherein said adjusting at least one electrophotographic image forming parameter comprises adjusting said at least one electrophotographic image forming parameter based on said offset value.

2. The method of claim 1 wherein a temperature sensor is associated with said detector, and wherein said adjusting at least one electrophotographic image forming parameter comprises adjusting at least one electrophotographic image forming parameter based on a temperature sensed by said temperature sensor.

3. The method of claim 1 wherein said generating a toner patch inside said housing comprises generating a toner patch on an intermediate transfer medium disposed inside said housing.

4. The method of claim 1 wherein said adjusting at least one electrophotographic image forming parameter comprises adjusting at least one of the group selected from developer bias, photoconductive drum voltage, laser power, and white vector.

5. The method of claim 1 further comprising:

after said emitting light from said emitter onto a first reference sample and measuring the light reflected therefrom with said detector, emitting light from said emitter onto a second reference sample having a predetermined second reflectivity and measuring the light reflected therefrom with said detector; said second reflectivity different from said first reflectivity;

adjusting said duty cycle of said pulse width modulation control signal so as to cause a second signal corresponding to said light reflected from said second reference sample and measured by said detector to substantially match a second predetermined target;

storing said adjusted duty cycle as a second characterization value in said memory, said second characterization value comprising a second duty cycle value corresponding to said adjusted duty cycle used to amplify said second signal to substantially match said second predetermined target; and thereafter, generating a second toner patch inside said housing and measuring a reflectance of said second toner patch with said emitter and detector based on said second characterization value while said emitter and detector are operatively connected to said power supply, and adjusting at least a second electrophotographic image forming parameter based thereon.

6. The method of claim 5 wherein said second toner patch comprises toner having a color not present in said first toner patch.

7. The method of claim 5 wherein said second characterization value is determined prior to said generating a first toner patch.

8. The method of claim 1 wherein said associating an emitter and an associated detector with said housing occurs after said associating said power supply with said housing.

9. The method of claim 1 wherein said first toner patch comprises black toner.

10. The method of claim 1, wherein a gain of said detector is adjusted based on said first characterization value depending on a type of toner patch being sensed by said detector.

11. The method of claim 1, wherein said first predetermined target is calculated based on said predetermined first reflectivity of said first reference sample.

12. The method of claim 1, wherein the first characterization value is a duty cycle value between zero and 100.

13. A method of operating an electrophotographic image forming device having a power supply, comprising:

emitting light from an emitter onto a first reference sample having a predetermined first reflectivity and measuring the light reflected therefrom with a detector, said emitter and said detector operatively coupled to the power supply;

adjusting a duty cycle of a pulse width modulation control signal so as to cause a first signal corresponding to said reflected light from said first reference sample and measured by said detector to substantially match a predetermined target;

storing said adjusted duty cycle in a memory as a first characterization value, said first characterization value comprising a first duty cycle value corresponding to said adjusted duty cycle used to amplify said first signal to substantially match said first predetermined target;

thereafter, generating a first toner patch with the electrophotographic image forming device and measuring a reflectance of said first toner patch with said emitter and detector based on said first characterization value while said emitter and detector are operatively connected to said power supply;

adjusting at least one electrophotographic image forming parameter based on said measured reflectance: and prior to said generating a first toner patch, removing said first reference sample, emitting light from said emitter with no reference sample for said light to reflect on, measuring a signal output of said detector while driving said detector according to said first characterization value, and determining an offset value corresponding to a difference between said signal output and the first signal as amplified by said adjusted duty cycle;

wherein said adjusting at least one electrophotographic image forming parameter comprises adjusting at least one electrophotographic image forming parameter based on said measured reflectance and said offset value.

14. The method of claim 13 wherein a temperature sensor is associated with said detector, and wherein said adjusting at least one electrophotographic image forming parameter comprises adjusting at least one electrophotographic image forming parameter based on said measured reflectance and a temperature sensed by said temperature sensor.

15. The method of claim 13 wherein said generating a toner patch comprises generating a toner patch on an intermediate transfer medium.

16. The method of claim 13 further comprising:

after said storing said adjusted duty cycle as a first characterization value, emitting light from said emitter onto a second reference sample having a predetermined second reflectivity and measuring the light reflected therefrom with said detector; said second reflectivity different from said first reflectivity;

adjusting said duty cycle of said pulse width modulation control signal so as to cause a second signal corresponding to said light reflected from said second reference sample and measured by said detector to substantially match a second predetermined target;

storing said adjusted duty cycle in said memory as a second characterization value, said second characterization value comprising a second duty cycle value corresponding to said adjusted duty cycle used to amplify said second signal to substantially match said second predetermined target;

thereafter, generating a second toner patch with the electrophotographic image forming device and measuring a reflectance of said second toner patch with said emitter and detector based on said second characterization value while said emitter and detector are operatively connected to said power supply; and adjusting at least a second electrophotographic image forming parameter based on said measured reflectance associated with said second toner patch.

17. The method of claim 16 wherein said second reflectivity is larger than said first reflectivity.

18. The method of claim 16 wherein said second characterization value is determined prior to said generating a first toner patch.

19. The method of claim 13 wherein said emitting light from said emitter onto said first reference sample comprises emitting infrared light from said emitter onto said first reference sample.

20. An electrophotographic image forming device, comprising:

a toner patch sensor including an emitter and a detector, the emitter for emitting light onto a first reference sample having a predetermined first reflectivity, and the detector for measuring light reflected from the first reference sample and producing a first signal corresponding to the light reflected;

an amplifier operatively coupled to an output of the detector for amplifying the first signal; and control circuitry including memory, the control circuitry providing a pulse width modulation control signal to the amplifier for controlling amplification of the first signal;

wherein the control circuitry adjusts a duty cycle of the pulse width modulation control signal so as to cause the first signal to substantially match a first predetermined target, stores the adjusted duty cycle in the memory as a first characterization value, and subsequently adjusts a setting of the toner patch sensor based on the first characterization value depending on a type of toner patch being sensed by the toner patch sensor; and wherein the emitter emits light with no reference sample for the light to reflect on, and the detector produces a signal output corresponding to tight received by the detector with no reference sample while the control circuitry causes the detector to be driven according to the first characterization value, the control circuitry determining an offset value corresponding to a difference between the signal output and the first signal as amplified by the adjusted duty cycle, and adjusting at least one electrophotographic image forming parameter based on the offset value.

21. The device of claim 20, wherein the first characterization value is a duty cycle value between zero and 100.

22. A method of operating an electrophotographic image forming device, comprising:

providing a housing;

associating a power supply with said housing;

associating a control circuit including memory with said housing;

associating an emitter and an associated detector with said housing;

operatively coupling said emitter and said detector to said power supply and said control circuit;

thereafter, while said emitter and detector are operatively connected to said power supply, emitting light from said emitter onto a first reference sample having a predetermined first reflectivity, measuring the light reflected therefrom with said detector, and producing a first signal corresponding to said light reflected from said first reference sample;

adjusting a duty cycle of a pulse width modulation control signal so as to cause said first signal to substantially match a first predetermined target;

storing said adjusted duty cycle in said memory as a first characterization value, said first characterization value comprising a first duty cycle value corresponding to said adjusted duty cycle used to amplify said first signal to substantially match said first predetermined target; and thereafter, generating a first toner patch inside said housing and measuring a reflectance of said first toner patch with said emitter and detector based on said first characterization value while said emitter and detector are operatively connected to said power supply, and adjusting at least one electrophotographic image forming parameter based thereon;

wherein a gain of said detector is adjusted based on said first characterization value and depending on a type of toner patch being sensed by said detector.

* * * * *